US006043730A

United States Patent [19]

Maenishi et al.

[11] Patent Number: 6,043,730

[45] **Date of Patent: *Mar. 28, 2000**

[54] ELECTROMAGNETIC ACTUATOR

[75] Inventors: Kozo Maenishi; Kazuo Tsuboi, both of Kyoto, Japan

[73] Assignee: Omron Corporation, Kyoto-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,096

[22] Filed: Sep. 27, 1996

[30] Foreign Application Priority Data

Sep. 27, 1995 [JP] Japan ..... 7-249755

[51] Int. Cl.[7] ..... H01F 7/14; H01F 7/08

[52] U.S. Cl. ..... 335/229; 335/78; 335/79; 335/80; 335/85; 335/128; 335/179; 335/181; 335/229; 335/276

[58] Field of Search ..... 335/78–86, 128, 335/229–234, 275, 276, 177, 179, 181

[56] References Cited

U.S. PATENT DOCUMENTS

| | | | |
|---|---|---|---|
| 2,941,130 | 6/1960 | Fischer et al. | 335/230 |
| 3,673,529 | 6/1972 | Garratt et al. | 335/234 |
| 4,385,280 | 5/1983 | Reisem | 335/230 |
| 4,437,081 | 3/1984 | Wyatt | 335/229 |
| 4,465,992 | 8/1984 | Fowler | 335/205 |
| 4,467,304 | 8/1984 | Reisem | 335/227 |
| 4,551,698 | 11/1985 | Aidn | 335/78 |

FOREIGN PATENT DOCUMENTS

| | | | |
|---|---|---|---|
| 84110 | 5/1982 | Japan | 335/230 |
| 102005 | 6/1982 | Japan | 335/230 |
| 99714 | 6/1982 | Japan | 335/230 |
| 501430 | 7/1977 | U.S.S.R. | 335/229 |

*Primary Examiner*—Michael L. Gellner
*Assistant Examiner*—Raymond Barrera
*Attorney, Agent, or Firm*—Morrison & Foerster LLP

[57] ABSTRACT

An electromagnetic actuator has an iron core around which a coil is wound; two permanent magnets, the same poles of which are placed on the ends of the core which extend beyond the coil and which have the same direction of polarity; magnetic poles formed on either end of the iron core; a yoke which connects the poles of the magnets opposite those which face the core; and an iron armature which is supported by a fulcrum on the yoke in such a way that it is free to rotate around the fulcrum, and which has on either end a magnetic pole which faces one of the poles of the core.

11 Claims, 8 Drawing Sheets

Fig. 1(A)
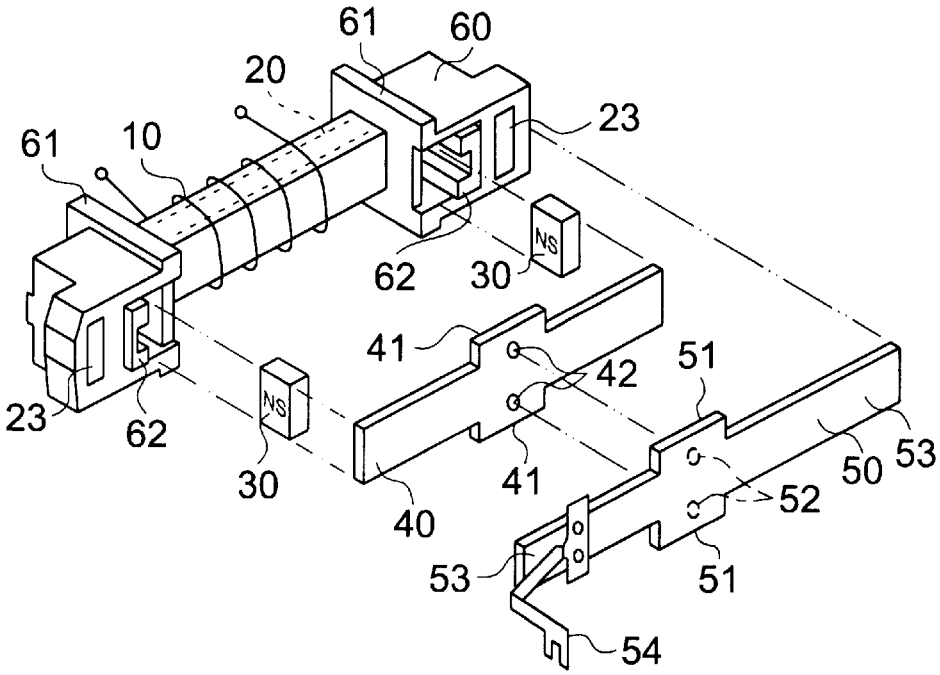
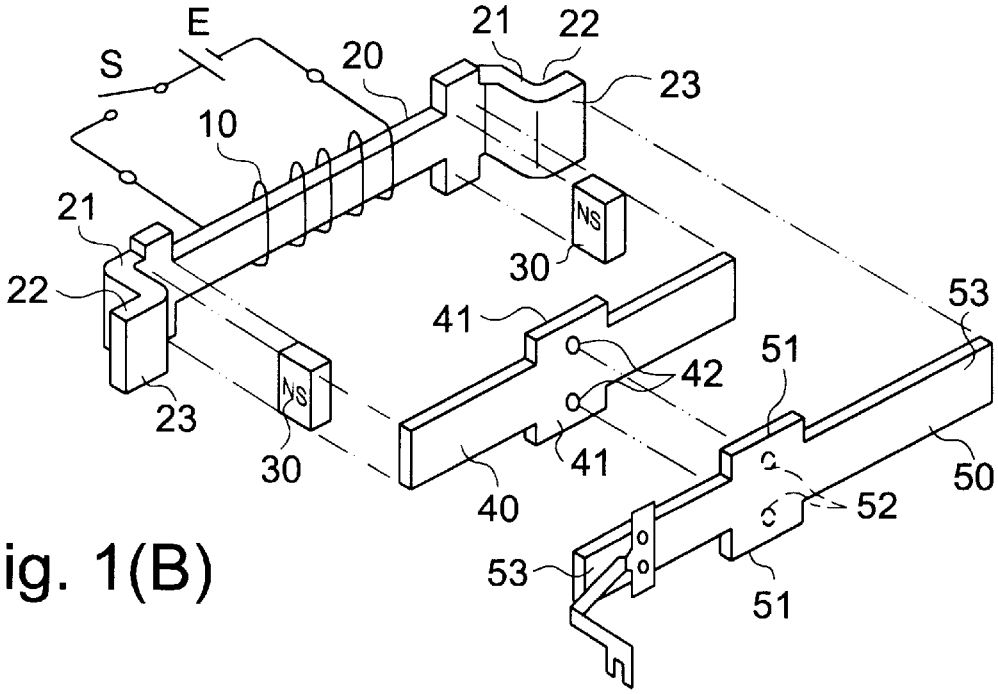
Fig. 1(B)

Fig. 2
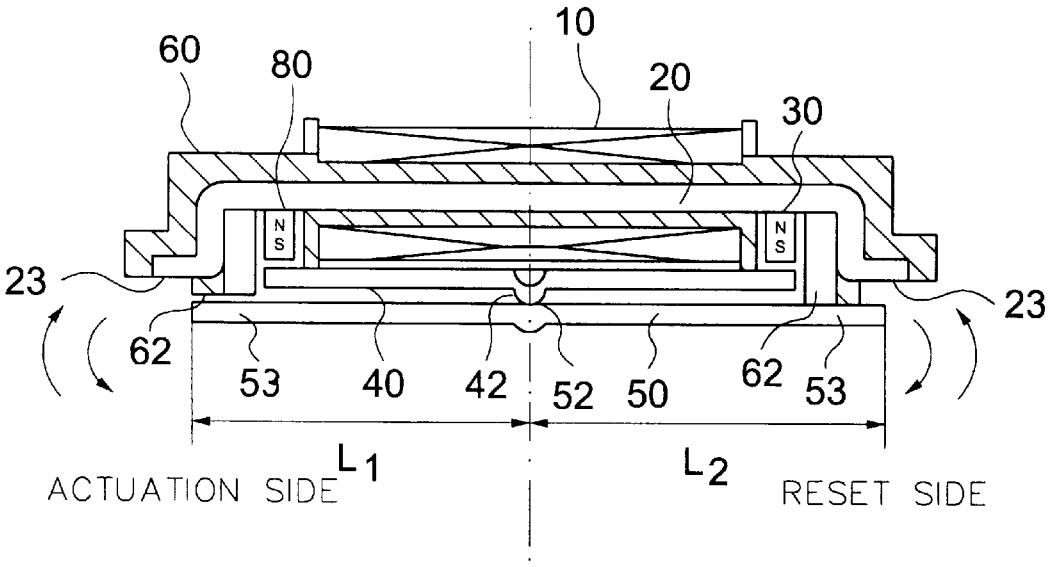
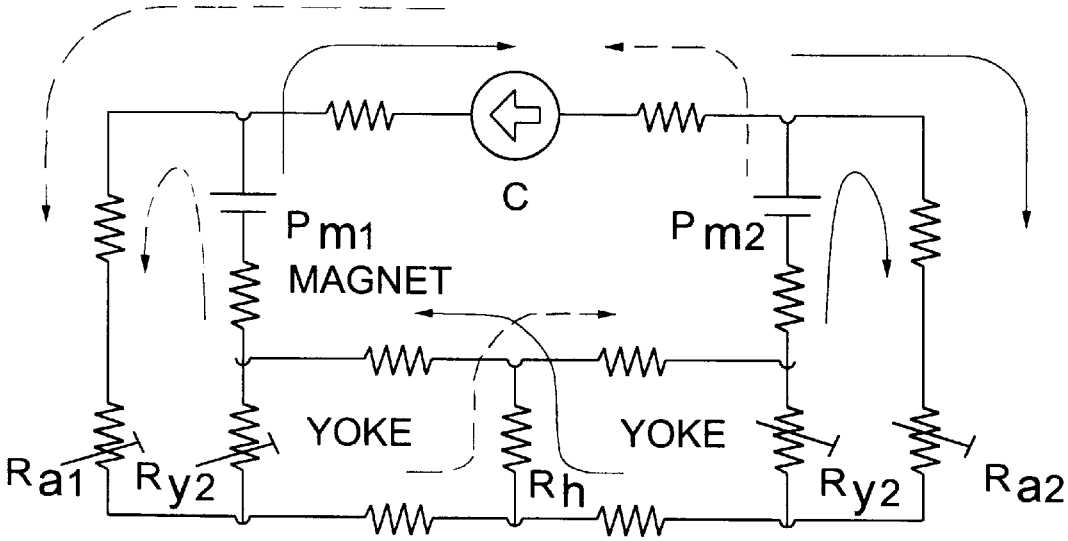
Fig. 3

Fig. 4(A)
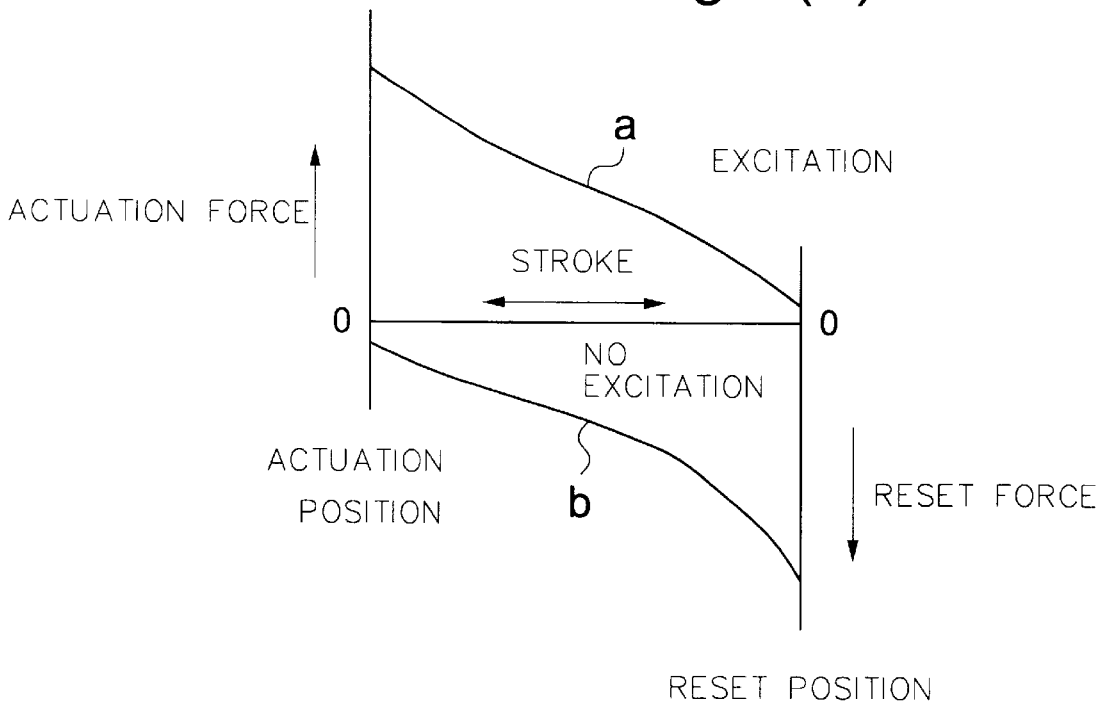
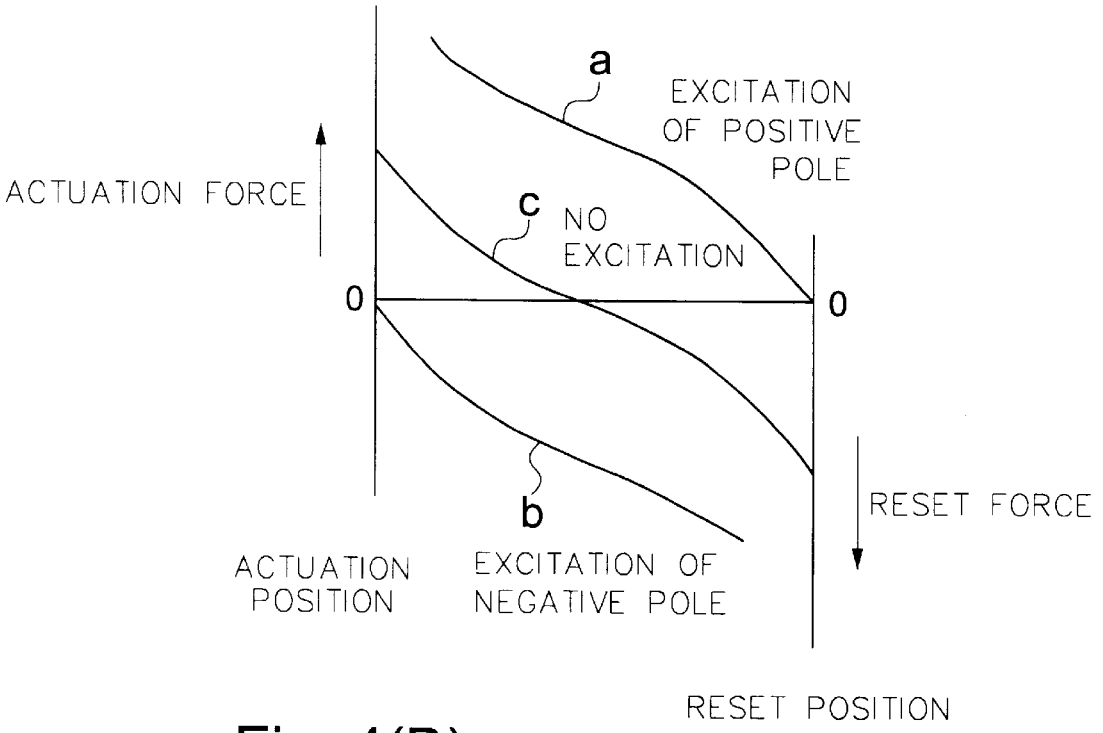
Fig. 4(B)

Fig. 5(A)
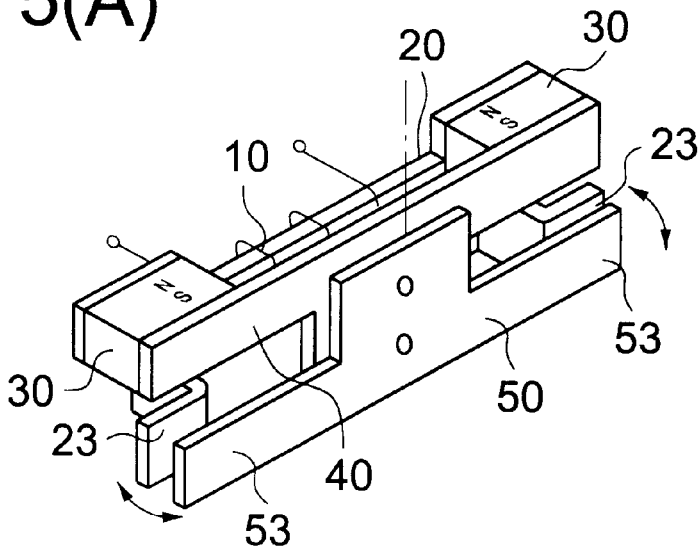
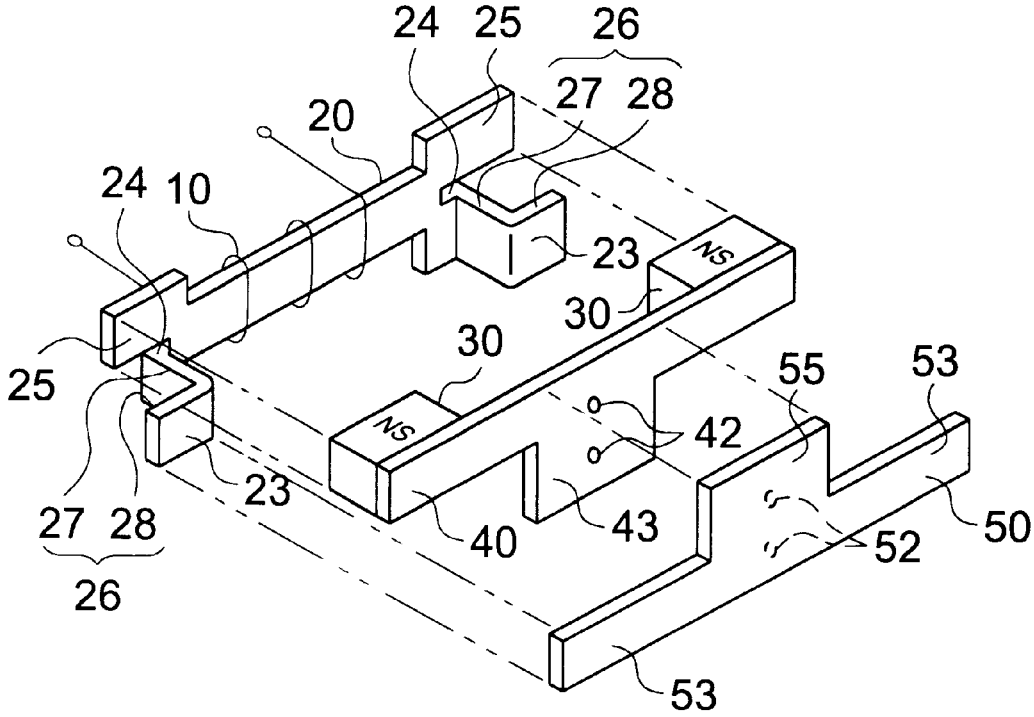
Fig. 5(B)

Fig. 6(A)
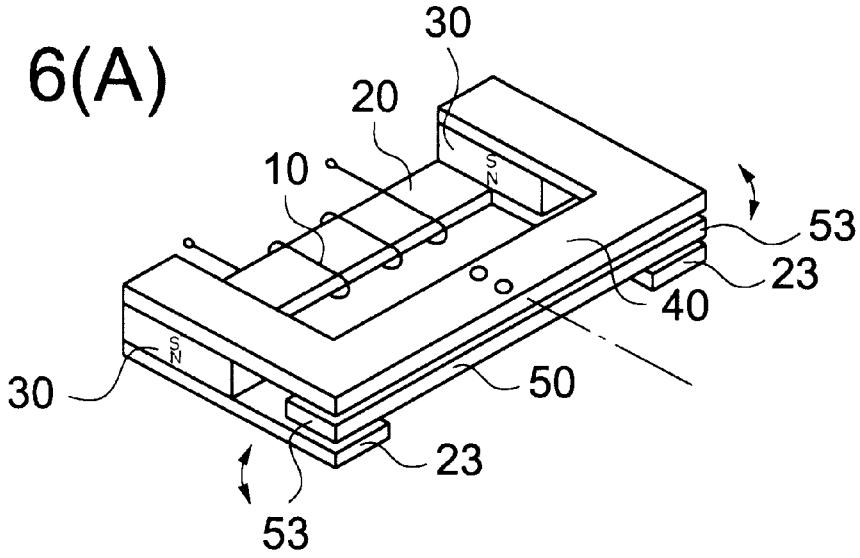
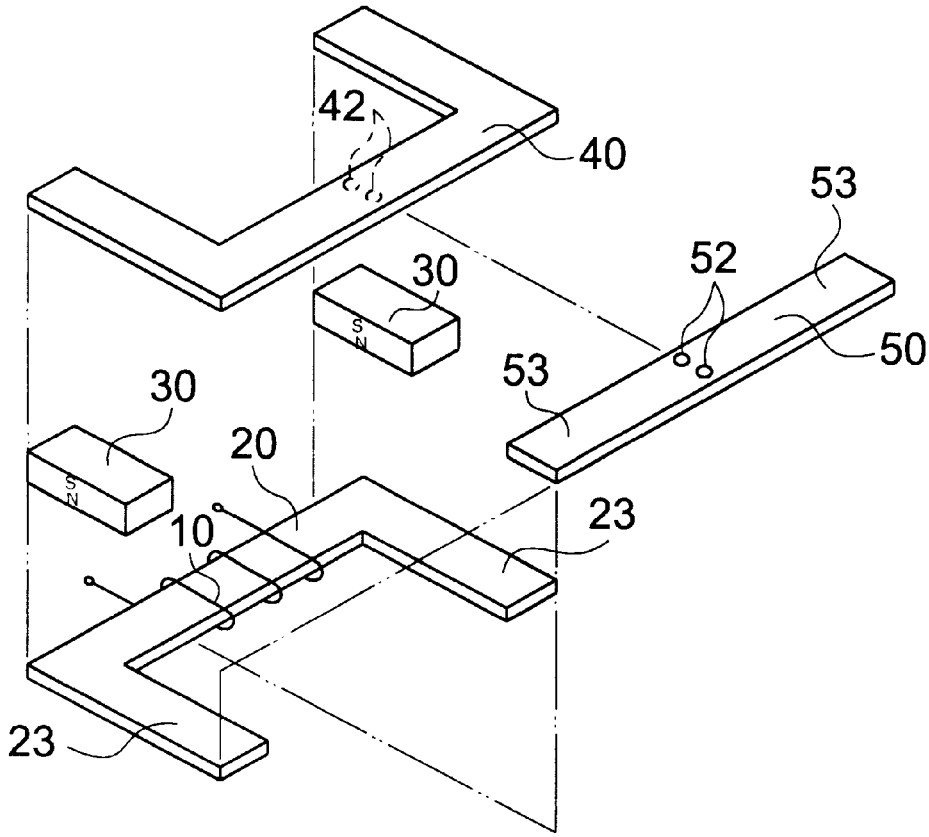
Fig. 6(B)

Fig. 7(A)
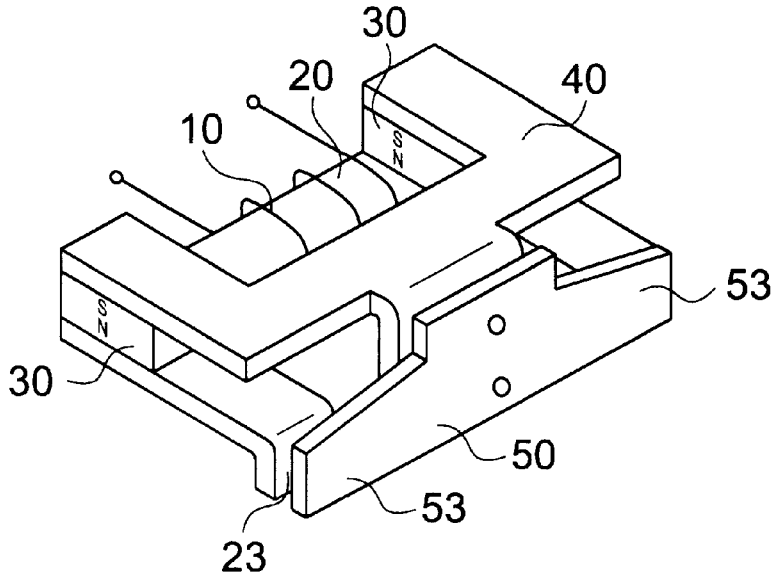
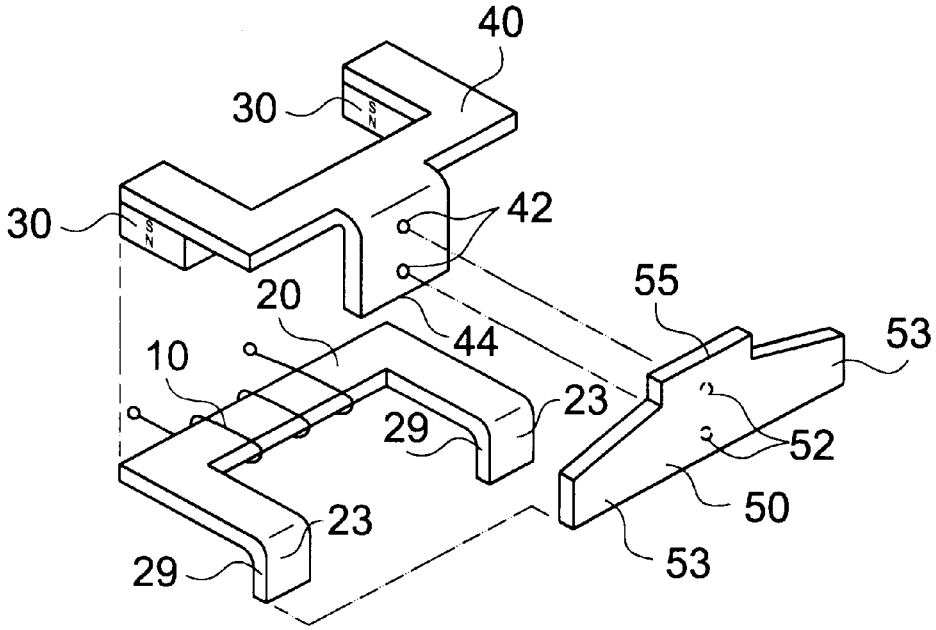
Fig. 7(B)

ELECTROMAGNETIC ACTUATOR

FIELD OF THE INVENTION

This invention concerns an electromagnetic actuator to be used primarily in miniature relays.

BACKGROUND OF THE INVENTION

Previously available electromagnetic actuators using a magnetic circuit are shown in FIGS. 8 and 9.

In the electromagnetic actuator depicted in FIG. 8, magnetic poles 3 are formed on the bent ends of iron core 2, around which coil 1 is wound. Permanent magnet 4 is placed in the center of the portion where the coil is wound around core 2. Permanent magnet 4 is supported by iron armature 5 in such a way that it is free to rotate. Magnetic poles 6, on either end of the said iron armature 5, face the magnetic poles 3 of the iron core.

The electromagnetic actuator shown in FIG. 9 has its magnetic poles 3 on the bent ends of iron core 2, around which coil 1 is wound. Between the two magnetic poles 3 of the core is placed permanent magnet 4, which has three point magnetized poles N-S-N (or S-N-S). The pole in the center of the said permanent magnet 4 supports iron armature 5, which has a projection 7 which acts as a fulcrum so that the iron armature 5 is free to rotate. The magnetic poles 6 on the ends of iron armature 5 face the magnetic poles 3 of iron core 2.

In the electromagnetic actuator shown in FIG. 8, permanent magnet 4 is placed on the portion of the core on which the coil is wound, so that the space for winding the coil is particularly limited in the miniature type of relay, in which the space is actually shorter than 2 centimeter. This decreases the number of turns by which coil 1 may be wound. Because permanent magnet 4 effectively divides in half the portion of the core on which the coil is wound, the wire winding equipment has to be more complex. In FIG. 8, the coil must be wound more slowly around the center portion of the core between the left and right portions of the coil, which increases the winding time. Since the wire is so thin (0.022–0.073 mm depending on the input voltage), the wire is also prone to break as it is led across the center of the core.

Because the electromagnetic actuator pictured in FIG. 9 requires a permanent magnet 4 which is point magnetized in three places, the material is limited to a relatively point magnetic type such as isotropic ferrite or ferric chrome cobalt. Also, the cost is driven up by the fact that it is difficult to magnetize the material once the actuator is assembled. In general, isotropic ferrite can make a unoriented magnet having a maximum magnetic energy content of approx. 6.5 $(BH)_{max}$kj/m$^3$, and anisotropic ferrite can make a oriented magnet having a maximum magnetic energy content of approx. 25.0 $(BH)_{max}$kj/m$^3$, which is stronger than that of the unoriented magnet.

SUMMARY OF THE INVENTION

This invention overcomes the disadvantages of the prior art described above by providing a less costly electromagnetic actuator whose permanent oriented magnet would be situated away from the coil so that the coil need not be wound across the magnet, and whose permanent magnet may be magnetized easily.

The first embodiment of this invention has the following components: an iron core around which is wound a coil; two permanent magnets with identically oriented polarity, whose corresponding poles are placed on either end of the portion of the iron core which extends beyond the aforesaid coil; two magnetic poles which are formed on either end of the iron core; a yoke which connects the magnetic poles of the permanent magnets which are opposite those which face the iron core; and a flat iron armature which has its fulcrum on the yoke, which is supported in such a way that it is free to rotate around its fulcrum, and which has at each end a magnetic pole which faces one of the magnetic poles of the core.

With this first embodiment of the invention, the permanent magnets are placed on either end of the iron core on which the coil is wound rather than in the center of the portion where the coil is wound. This makes it much easier to wind the coil and allows the coil to cover a greater area, which improves the magnetic attraction. Because the permanent magnets are placed on either end of the portion of the core where the coil is wound, much of the magnetic flux of the magnets is added to the flux of the coil. This allows the magnets to be miniaturized. Both permanent magnets have the same direction of polarity, so they can easily be magnetized after the actuator is assembled.

In this first embodiment, the ends of the core around which the coil is wound are bent perpendicular to the axis of the coil, and then bent again so that they are parallel to the axis. The magnetic poles of the core are formed on the portions which are parallel to the axis of the coil. It is desirable that the permanent magnets be placed in the space between the bent portions of the core and oriented in the same direction as the first bend. In this way the magnets will be sandwiched between the coil and the bent portion of the core. This will minimize flux leakage and allow the magnets to be miniaturized.

The second embodiment of this invention has, in addition to the features of the first embodiment, the following: the ends of the core around which the coil is wound are bifurcated in two planes which are virtually parallel to the axis of the coil; two permanent magnets are placed so that one of their poles faces one of the bifurcations, and both poles lie in a plane which is perpendicular to the axis of the coil; and the other bifurcations are bent in the same direction as the poles of the permanent magnets and then bent again at another right angle so that the magnetic poles of the core can be formed on two surfaces which are virtually (or substantially) parallel to the axis of the coil.

With this second embodiment of the invention, the magnetic poles of the core and the permanent magnets are both perpendicular to the axis of the coil, an arrangement which allows the actuator to be made shorter and smaller.

The third embodiment of this invention has the following components: a roughly [-shaped iron core around whose central portion a coil is wound; two permanent magnets whose poles are oriented in the same direction on either end of the middle portion of the core where it extends beyond the coil, and whose magnetic poles are oriented in the direction of the thickness of the core; magnetic poles of the core, which are formed on extensions of the surfaces on which the permanent magnets are placed on either end of the core; a roughly [-shaped yoke, whose surface is placed parallel to the core so that its extremities face the magnetic poles of the permanent magnets which are opposite those which face the core; and a flat iron armature which has a rotary fulcrum in the center of the long surface of the yoke on the side which faces the permanent magnets, whose central portion is supported by the rotary fulcrum in such a way that it is free to rotate, and which has at each end a magnetic pole which faces one of the magnetic poles of the core.

With this third embodiment of the invention, the iron armature is sandwiched into the space between the yoke and the core. This arrangement reduces the dead space and allows the actuator to be made smaller. Building the actuator out of a flat [-shaped iron core and a flat [-shaped yoke oriented in the opposite way with the permanent magnets sandwiched between the two Us allows the product to be made thinner.

The fourth embodiment of this invention has the following components: a flat, roughly [-shaped iron core around whose central portion a coil is wound; two permanent magnets, whose same poles are placed on either end of the central portion of the core which extends beyond the coil, and whose poles are oriented along the thickness direction of the core; magnetic poles of the core, which are formed on portions of the core which make right angles with the surfaces on which the permanent magnets are placed, which themselves are formed by bending the ends of the core in the direction of its thickness along a line virtually (or substantially) parallel to the axis of the coil; a yoke shaped roughly like an inverted U, which is placed parallel to the core so that its ends face the poles of the permanent magnets which are opposite those which face the core; a tongue on the yoke, an extension in the center of the yoke which is bent in the direction of the thickness of the core along a line virtually (or substantially) parallel to the axis of the coil, and which has a rotary fulcrum on its surface which is parallel to the magnetic poles of the core; and a flat iron armature with magnetic poles which face the poles on either end of the core, whose central portion is supported by the fulcrum in such a way that the armature is free to rotate.

With this fourth embodiment of the invention, operational results are achieved which are identical to those of the third embodiment described above. The only difference here is that the direction in which the iron armature rotates in the fourth embodiment is at a right angle to the direction of rotation of that armature in the third embodiment. This choice of designs allows the user to arrange the electromagnetic actuator in a fashion appropriate to the location and direction in which power is required to be applied.

In any of the embodiments of the invention described above, it is possible to use two permanent magnets of different strengths. This would be a simple way to construct what is known as a single-action (monostable) electromagnetic actuator.

It is desirable that the four non-polar surfaces of the permanent magnets sandwiched between the core and the yoke be integral with the spool around which the coil is wound. This stabilizes the position of the magnets and reduces variation in their characteristics.

It is also desirable that the rotary fulcrum of the iron armature be formed at two points in a plane which is orthogonal to a line linking the magnetic poles of the core. This will insure that the rotary action of the armature is prevented.

BRIEF DESCRIPTION OF THE DRAWINGS

FIG. 1 shows an idealized view of an electromagnetic actuator of the first embodiment of this invention. FIG. 1(A) is an exploded perspective drawing, and FIG. 1(B) is an exploded perspective drawing without the spool.

FIG. 2 is a horizontal cross section of the electromagnetic actuator shown in FIG. 1.

FIG. 3 is a diagram of the magnetic circuit in the electromagnetic actuator shown in FIG. 1.

FIG. 4 shows magnetic attraction curves for the electromagnetic actuator in FIG. 1. FIG. 4(A) is the curve for a monostable actuator. FIG. 4(B) is the curve for a latching actuator.

FIG. 5 shows an idealized view of an electromagnetic actuator of the second embodiment of this invention. FIG. 5(A) is a perspective drawing of the assembled actuator; FIG. 5(B) is an exploded drawing of the same actuator.

FIG. 6 shows an idealized view of an electromagnetic actuator of the third embodiment of this invention. FIG. 6(A) is a perspective drawing of the assembled actuator; FIG. 6(B) is an exploded drawing of the same actuator.

FIG. 7 shows an idealized view of an electromagnetic actuator of the fourth embodiment of this invention. FIG. 7(A) is a perspective drawing of the assembled actuator; FIG. 7(B) is an exploded drawing of the same actuator.

DETAILED DESCRIPTION OF THE INVENTION

Figure 8:
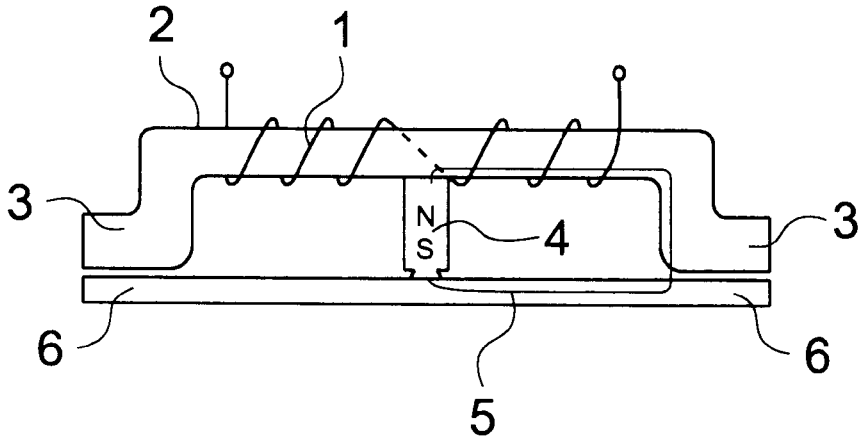
Fig. 8 PRIOR ART
FIG. 8 is a rough sketch of a prior art electromagnetic actuator.
Figure 9:
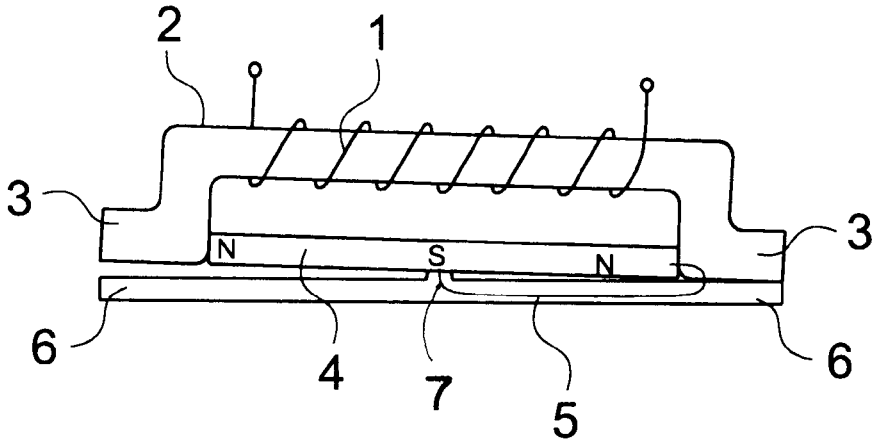
Fig. 9 PRIOR ART
FIG. 9 is a rough sketch of another prior art electromagnetic actuator.
Figure 10:
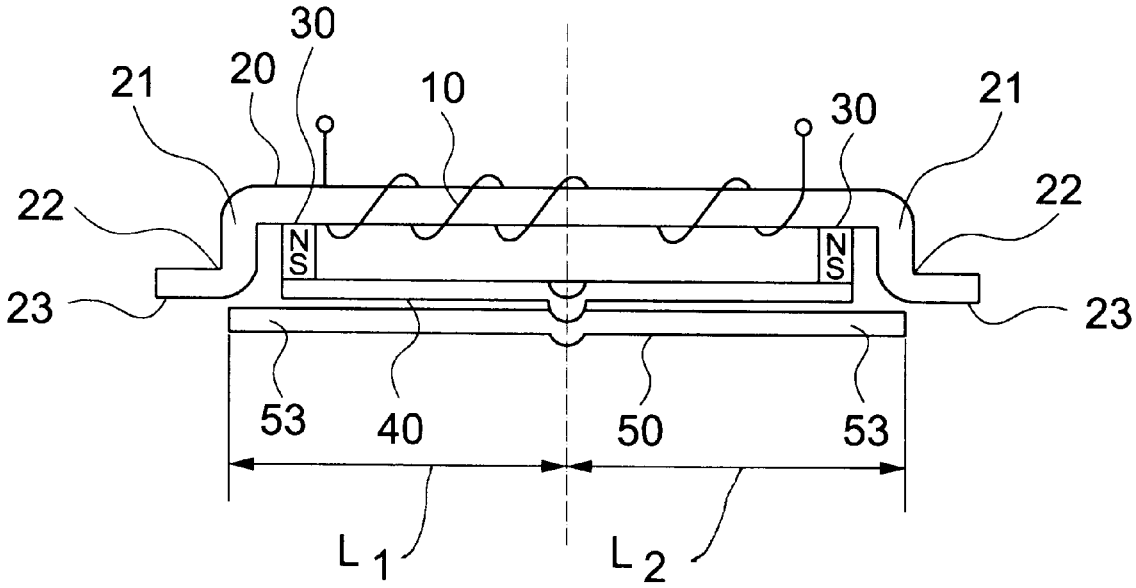
FIG. 10 is a rough sketch of an electromagnetic actuator designed according to this invention.

FIG. 10 is a rough drawing of an electromagnetic actuator incorporating this invention, and FIG. 1 shows the first embodiment of an electromagnetic actuator incorporating this invention. This actuator has an iron core 20, around which coil 10 is wound; two permanent magnets 30; yoke 40; and iron armature 50. The drawings of the embodiments of the invention provided in this application are idealized, that is, they are not intended to be engineering drawings, so that actual electromagnetic actuators which may be made by persons skilled in the art following the disclosure of this application may differ in certain details.

Referring to FIGS. 1(A) and 1(B), the ends of core 20, around which coil 10 is wound, are bent at right angles to the axis of coil 10 to produce first bent portions 21 and then bent again along lines at right angles to the axis to produce second bent portions 22. The magnetic poles 23 of the iron core are formed on the surfaces of second bent portions 22 which are parallel to the axis of coil 10. Flattened second bent portions 22 are provided to increase the area of magnetic poles 23 and to reduce the magnetic reluctance resulting from the working gap.

Permanent magnets 30 have the form of identical rectangular parallelepipeds. One magnet is placed on either end of the core 20 at a given distance from bent portion 21. Magnets 30 are magnetized so that their sides which face core 20 will both be N poles and their opposite sides will both be S poles or vice versa. The path between their N and S poles (i.e., the direction of their polarity) will be orthogonal to the axis of coil 10.

Iron core 20 and the two permanent magnets 30 are insert-molded so as to be integral to spools 60, as shown in FIG. 1(A). Spool 60 has a flange 61 on either end of core 20. Coil 10 is wound between these two flanges 61. The magnetic poles 23 of core 20 and the S poles of permanent magnets 30 are exposed to the exterior in spool 60. Pole extensions 62, which are of a single piece with spool 60, project slightly beyond the surfaces of poles 23 between bent portions 21 and magnets 30. With the exception of their N and S poles, all the surfaces of the permanent magnets 30 are integral with spool 60, so the position of the magnets remains stable.

Yoke 40 comprises a rectangular plate. Its ends face the S poles of the permanent magnets 30, and it connects those two S poles. In the center of yoke 40 are two projections 41 on either side of the yoke which cause the central portion to be wider than the extremities. In this central portion, on the side which does not face the S poles of permanent magnets 30, is rotary fulcrum 42, comprising two rounded protrusions along a line which is orthogonal to the axis of coil 10.

Armature 50 comprises a plate of virtually (or substantially) the same shape as yoke 40, but slightly longer. It has two projections 51 on either side of its central portion. In the center of armature 50, on the side which faces yoke 40, are two indentations 52 which engage with protrusions 42 on the yoke 40. The magnetic poles 53 of armature 50 are on its extremities. When indentations 52 on armature 50 engage with protrusions 42 on yoke 40, the protrusions 42 (i.e., the rotary fulcrum) are supported in such a way that armature 50 is free to rotate around its center. Two protrusions 42 are provided in order to insure stable rotation of armature 50. The magnetic poles 53 on either end of armature 50 face the magnetic poles 23 of the core at a spacing which corresponds to the actuation distance.

The length $L_1$ of the armature 50 from its rotary fulcrum 42 to the end of its left side (hereafter, its "actuation side") is shorter than its length $L_2$ from the fulcrum to the end of its right side (hereafter, its "reset side"), as can be seen in FIG. 2. Thus a different amount of the surface area of the magnetic pole 53 of the armature and the magnetic pole 23 of the core comes face to face on the actuation side and the reset side. This creates a magnetic imbalance which enables a monostable operation such that the actuator actuates under conditions of excitation and resets when no excitation occurs. Extension 54 engages with a fiber optic or other component, which is not pictured in the drawing, to which power is to be applied.

We shall next explain the operation of an electromagnetic actuator configured as described above.

FIG. 3 shows the magnetic circuit in the electromagnetic actuator pictured in FIG. 1.

C: Magnetomotive force generated by coil 10

$P_{m1}$: Magnetic force of permanent magnet 30 on actuation side $P_{m2}$: Magnetic force of permanent magnet 30 on reset side $R_{a1}$: Magnetic reluctance between pole 23 on actuation side of core and apposed pole 53 of iron armature $R_{a2}$: Magnetic reluctance between pole 23 on reset side of core and apposed pole 53 of iron armature $R_{y1}$: Magnetic reluctance between actuation side of yoke 40 and armature 50

$R_{y2}$: Magnetic reluctance between reset side of yoke 40 and armature 50

$R_h$: Magnetic reluctance between rotary fulcrum 42 of yoke 40 and indentations 52 on armature 50.

The internal magnetic reluctances of the magnetic paths of core 20, yoke 40 and armature 50 are indicated by the reluctance symbols without labels.

When coil 10 is not in a state of magnetic excitation, the interval distances between the magnetic poles 53 on the actuation and reset sides of the iron armature, and the magnetic poles 23 of the core will be identical (the midpoint of the actuation stroke). Permanent magnets 30 produce two types of magnetic flux: flux which acts in the actuation direction (shown by broken lines in FIG. 3) and flux which acts in the reset direction (shown by solid lines in FIG. 3). As can be seen in FIG. 2, the portions of armature 50 which are on the actuation side and reset side are of different lengths ($L_1<L_2$) . Thus the magnetic reluctance $R_{a1}$ between the magnetic pole 23 of the core and the magnetic pole 53 of the armature is greater on the actuation side than the reluctance $R_{a2}$ on the reset side, and the magnetic attraction due to the magnetic flux of actuation is greater on the reset side than that on the actuation side. As a result, armature 50 rotates counterclockwise as shown in FIG. 2, and pole 53 on its actuation side moves away from pole 23 of the core. Pole 53 on the reset side is attracted to the corresponding pole 23 of the core and travels in that direction until its movement is checked by pole extension 62. In this state, the magnetic flux which goes through core 20 around which coil 10 is wound (the combination of the fluxes shown by solid and broken lines) goes away from permanent magnet $P_{m1}$ and toward permanent magnet $P_{m2}$.

When coil 10, which is wound around core 20, is excited in such a way as to generate a magnetic flux flowing in the opposite direction from the flux traversing core 20 from permanent magnet $P_{m1}$ to $P_{m2}$, the magnetic flux acting on the actuation side (shown by broken lines in FIG. 3) increases, and the magnetic flux acting on the reset side (shown by solid lines) decreases. As a result, armature 50 rotates clockwise, as shown in FIG. 2. The magnetic pole 53 on its actuation side moves toward the corresponding pole 23 of the core until it is stopped by pole extension 62, and the magnetic pole 53 on its reset side moves away from the corresponding pole 23 of the core.

When the excitation of coil 10 is halted, the magnetic flux acting in the actuation direction (shown by broken lines in FIG. 3) decreases, and that acting in the reset direction (shown by solid lines) increases. Armature 50 rotates in the reset direction and remains in the reset state shown in FIG. 2.

The magnetic attraction curve for this type of single action is shown in FIG. 4(A). When coil 10 is excited with armature 10 in the reset position, the actuation force increases according to magnetic attraction curve a, and armature 50 rotates toward the actuation side. When the excitation of coil 10 is halted, the reset force increases according to magnetic attraction curve b, and armature 50 rotates toward the reset side.

In the embodiment described above, a monostable action with different magnetic reluctance in the actuation and reset directions is achieved by offsetting rotary fulcrum 42 so that the two segments of armature 50 would be of different lengths ($L_1$ and $L_2$). The same sort of single action could also be achieved by making the two segments of armature 50 the same length but having the two pole extensions 62 protrude to different extents; making both the two halves of armature 50 and the two pole extensions 62 the same but varying either the strengths or the cross-sectional area of the two permanent magnets 30; offsetting the rotary fulcrum 42 for armature 50 from the center of yoke 40; or using some combination of these methods. In the embodiment discussed above, pole extension segments 62 are formed integral to spool 24 around which coil 10 is wound. However, it would be equally acceptable to form them by welding or caulking plates or rivets of a non-magnetic material to the surfaces of the magnetic poles of armature 50.

If instead of the single action described above a latching operation is required, it is desirable that the two segments of armature 50 be the same length from fulcrum 42 to their ends. In this case, coil 10 should have a single winding so that its polarity can be switched when it is excited. The magnetic attraction curves for this type of latching action are shown in FIG. 4(B). When the coil is excited, the magnetic attraction curve c for permanent magnets 30 is symmetrical with respect to the center of the stroke, so armature 50 is in either the reset position or the actuation position. Let us assume that armature 50 is initially in the reset position. When coil 10 is excited with a positive polarity, the actuation force will increase according to magnetic attraction curve a. Armature 50 will rotate toward the actuation side, and will be held in this state by the actuation force according to magnetic attraction curve c even when excitation is halted. When the coil is excited with a negative polarity, the reset force will increase according to magnetic attraction curve b, and armature 50 will rotate toward the reset side.

Instead of switching the polarity of coil 10 in this way and exciting it, it would be equally acceptable to provide two coils wound around core 20 in different directions and use one as the set coil and the other as the reset coil.

Next we shall discuss other idealized embodiments of this invention with reference to FIGS. 5 through 7. For the sake of simplicity, the spool has been omitted from these drawings, but it is to be understood that the spool is provided as shown in FIG. 2 or as will be apparent to persons skilled in this art. The pole extension segments, the core being divided into unequal lengths to produce a monostable action and the magnetic circuit, are all just the same as in the previously discussed first embodiment, so we shall not discuss these aspects further, but will limit our explanation to the components of these embodiments which differ from their counterparts in the first embodiment.

FIG. 5 shows a second idealized embodiment of the electromagnetic actuator of this invention. The ends of iron core 20, around which coil 10 is wound, are divided in two in the axial direction of coil 10 by slits 24 to form two bifurcations, 25 and 26. Bifurcation 26 has two segments, 27 and 28. Segment 27 is bent at substantially a right angle to the axis of coil 10, and segment 28 is formed by bending the end of segment 27 at another right angle to the axis of the coil. Magnetic poles 23 are formed on the surface of each segment 28 which is parallel to the axis of the coil.

Two permanent magnets 30 are placed on the ends of bifurcations 25 of the core 20. Magnets 30 are installed with their N poles both facing bifurcation 25 of core 20 and their S poles both facing away from it or vice versa, so long as the axes of their poles are orthogonal to the axis of coil 10.

The ends of yoke 40 face the S poles of the permanent magnets 30; the yoke serves to connect the S poles of the two magnets. In the middle of yoke 40 is a projection 43 on one side only, making the yoke somewhat wider in the center than it is on the ends. In this central portion, on the side which does not face the S poles of permanent magnets 30, is rotary fulcrum 42, comprising two rounded protrusions along a line which is orthogonal to the axis of coil 10.

Armature 50 has a projection 55 in its center on the opposite side from projection 43 on yoke 40. Other than that, it is of virtually (or substantially) the same shape as yoke 40. In the center of armature 50, on the side which faces the yoke 40, are two indentations 52 which engage with protrusions 42 on the yoke 40. The magnetic poles 53 of armature 50 are on its extremities. When indentations 52 on armature 50 engage with protrusions 42 on yoke 40, the protrusions 42 (i.e., the rotary fulcrum) are supported in such a way that armature 50 is free to rotate around its center. The magnetic poles 53 on either end of armature 50 face the magnetic poles 23 of the core at a spacing which corresponds to the actuation distance.

In this second embodiment, permanent magnets 30 and magnetic poles 23 are both oriented in the same plane, which is orthogonal to the axis of coil 10. This allows the overall length of the actuator to be shorter than that of the first embodiment, in which magnetic poles 23 were placed peripheral to magnets 30.

In this embodiment, armature 50 is placed on the outer side of yoke 40 (on the opposite side from coil 10); however, it would also be possible to place it on the inner side of the yoke, i.e., between core 10 and yoke 40. The permanent magnets and the magnetic poles could also be arranged symmetrically with respect to the axis of the yoke.

FIG. 6 shows a third idealized embodiment of the electromagnetic actuator of this invention. Both ends of core 20, a piece of flat stock around which coil 10 is wound, are bent in the same direction at a right angle to the axis of coil 10 so that the core ends up being shaped roughly like the shape "[". A magnetic pole 23 is formed on each end of core 20.

Two permanent magnets 30 are placed on the ends of the central segment of the core 20. Magnets 30 are installed with their N poles both facing core 20 and their S poles both facing away from it or vice versa, so long as the axis of their poles is orthogonal to the axis of coil 10.

Yoke 40 comprises a [-shaped plate which is a mirror image of the core 20. It is placed atop permanent magnets 30, which sit on the ends of core 20, so that its extremities face the S poles of those magnets and link them together. In the center of yoke 40, on the bottom surface shown in the drawing, is rotary fulcrum 42, comprising two rounded protrusions placed along a line which is orthogonal to the axis of coil 10.

Armature 50 comprises a rectangular plate of virtually (or substantially) the same width as the central portion of the yoke 40. On the central portion of its upper surface are two indentations 52 which the two protrusions 42 of the yoke 40 engage. Magnetic poles 53 are on either end. Armature 50 is sandwiched between the central portion of yoke 40 and the magnetic poles 23 of core 20. When the protrusions 42 on yoke 40 which constitute the rotary fulcrum engage its indentations 52, the fulcrum is held in such a way that the armature is free to rotate about its center. The magnetic poles 53 on either end of armature 50 face the magnetic poles 23 of the core at a spacing which corresponds to the actuation distance.

In this third embodiment, armature 50 is sandwiched between the magnetic poles 23 of core 20, which has been bent at a right angle to the axis of coil 10, and yoke 40. This arrangement allows the overall height of the actuator to be reduced so that it can have a flatter appearance.

FIG. 7 shows a fourth idealized embodiment of the electromagnetic actuator of this invention. This embodiment differs from the third only in regard to the shapes of core 20 and yoke 40, the installation of core 20 and the direction of rotation.

Both ends of core 20, around which coil 10 is wound, are bent downward (in the orientation shown in the drawing) along a line which is parallel to the axis of core 10 to form bent portions 29. Magnetic poles 23 are formed on the bent portions 29.

In the center of yoke 40 is a tongue 44, which is bent downward (in the orientation shown in the drawing) along a line which is parallel to the axis of core 10. On the outer surface of tongue 44 are two rounded protrusions which constitute rotary fulcrum 42. Protrusions 42 are arranged along a line which is orthogonal to the axis of coil 10.

When protrusions 42 on yoke 40 engage in indentations 52 on armature 50, the armature is held in such a way that it is free to rotate around rotary fulcrum 42. The magnetic poles 53 on either end of armature 50 face the magnetic poles 23 of the core at an interval which corresponds to the actuation distance.

In this fourth embodiment, armature 50 rotates in a horizontal plane, in contrast to the armature 50 of the third embodiment, which rotates in a vertical plane. Thus it is beneficial to employ the fourth embodiment of this actuator when the fiber optic or other component to which power is to be applied is to be driven in a horizontal direction.

In this embodiment, poles 23 of core 20 are bent downward in the drawing; however, they could be bent upward instead. Tongue 44 of yoke 40, too, could be bent upward as well. If core 20 is rotated in a different direction, the bent portions 29 of core 20 and the tongue 44 on yoke 40 can be bent in whatever fashion is appropriate.

What is claimed is:

1. An electromagnetic actuator, comprising:

an iron core;

a coil having a longitudinal axis and wound around said iron core;

two oriented permanent magnets placed on ends of said iron core extending beyond said coil, ends of said two oriented permanent magnets having corresponding magnetic polarity being placed on said ends of said iron core and whose direction of polarity is the same;

a substantially flat yoke provided with a first fulcrum connecting ends of opposite polarity of said two oriented permanent magnets; and a flat armature having a second fulcrum engaging with said first fulcrum of said flat yoke, said flat armature being held in such a way as to be free to rotate around said second fulcrum and facing magnetic poles on said ends of said iron core, wherein said flat yoke and said flat armature have longitudinal axes which are substantially parallel to the longitudinal axis of said coil, wherein said magnetic poles of said iron core comprise first and second bent portions, and a surface of said second bent portion is substantially parallel to the longitudinal axis of said iron core and to the longitudinal axis of said flat armature and wherein the electromagnetic actuator is assembled by stacking said iron core, said two oriented permanent magnets, said flat yoke and said flat armature one on top of another.

2. An electromagnetic actuator according to claim 1, wherein said iron core is [-shaped.

3. An electromagnetic actuator according to claim 1, wherein said two oriented permanent magnets are placed apart from said first bent portion.

4. An electromagnetic actuator according to claim 1, wherein said second fulcrum is located at a point which is off center in relation to a length of said flat armature in order to differentiate magnetic attraction between clockwise and counterclockwise rotations of said armature.

5. An electromagnetic actuator according to claim 1, wherein said magnetic poles on said ends of said iron core have different extents in order to differentiate magnetic attraction between clockwise and counterclockwise rotations of said flat armature.

6. An electromagnetic actuator according to claim 1, wherein said two oriented permanent magnets have different magnetic force in order to differentiate magnetic attraction between clockwise and counterclockwise rotations of said flat armature.

7. An electromagnetic actuator according to claim 1, wherein said two oriented permanent magnets are held in spools to stabilize position of said magnets.

8. An electromagnetic actuator according to claim 1, wherein said first and second fulcrums are formed on faces of said yoke and said flat armature perpendicular to a longitudinal axis of said iron core.

9. An electromagnetic actuator, comprising:

an iron core having ends, each of which is bifurcated into first and second faces which are substantially parallel to an axis of said iron core;

a coil wound about said iron core between said bifurcated ends;

two oriented permanent magnets placed on said first faces of said bifurcated ends of said iron core extending beyond said coil, ends of said two oriented permanent magnets having corresponding magnetic polarity being placed on said first faces of said bifurcated ends of said iron core and whose direction of polarity is the same;

a substantially flat yoke provided with a first fulcrum connecting ends of opposite polarity of said two oriented permanent magnets; and a flat armature having a second fulcrum engaging with said first fulcrum of said flat yoke, said flat armature being held in such a way as to be free to rotate around said second fulcrum and facing magnetic poles which are said second faces of said bifurcated ends of said iron core, wherein the electromagnetic actuator is assembled by stacking said iron core, said two oriented permanent magnets, said flat yoke and said flat armature one on top of another.

10. An electromagnetic actuator, comprising:

a [-shaped iron core;

a coil wound around said iron core;

two oriented permanent magnets placed on corners of said [-shaped iron core extending beyond said coil, ends of said two oriented permanent magnets having corresponding magnetic polarity whose direction of polarity is the same;

a substantially flat yoke which is a mirror image of said [-shaped iron core sandwiching said two oriented permanent magnets, said flat yoke being provided with a first fulcrum; and a flat armature having a second fulcrum engaging with said first fulcrum of said flat yoke, said flat armature being held in such a way as to be free to rotate around said second fulcrum and facing magnetic poles on ends of said [-shaped iron core, wherein the electromagnetic actuator is assembled by stacking said [-shaped iron core, said two oriented permanent magnets, said flat armature and said flat yoke one on top of another.

11. An electromagnetic actuator, comprising:

a [-shaped iron core having magnetic poles which extend at right angles to said iron core at ends of said iron core;

a coil wound around said iron core;

two oriented permanent magnets placed on corners of said [-shaped iron core extending beyond said coil, ends of said two oriented permanent magnets having corresponding magnetic polarity whose direction of polarity is the same;

a yoke sandwiching said two oriented permanent magnets at said corners of said [-shaped iron core, said yoke having a tongue extending substantially at a right angle to an axis of said yoke and having a first fulcrum on said tongue; and a flat armature disposed substantially at a right angle to an axis of said iron core, having a second fulcrum engaging with said first fulcrum of said yoke, said flat armature being held in such a way as to be free to rotate around said second fulcrum and facing magnetic poles on ends of said [-shaped iron core, wherein the electromagnetic actuator is assembled by stacking said [-shaped iron core, said two oriented permanent magnets and said yoke one on top of another and placing said flat armature next to said tongue of said yoke.

* * * * *